United States Patent [19]

Schechter

[11] 4,390,856

[45] Jun. 28, 1983

[54] MULTIPOLE SOLENOIDS

[75] Inventor: Michael M. Schechter, Southfield, Mich.

[73] Assignee: Ford Motor Company, Dearborn, Mich.

[21] Appl. No.: 289,008

[22] Filed: Jul. 31, 1981

[51] Int. Cl.[3] ..... H01F 7/08

[52] U.S. Cl. ..... 335/256; 335/266; 335/291

[58] Field of Search ..... 310/14, 27, 103; 335/256, 209, 268, 290, 291, 231, 266, 288, 245

[56] References Cited

U.S. PATENT DOCUMENTS

| | | | |
|---|---|---|---|
| 791,423 | 5/1905 | Ihlder | 335/423 |
| 2,448,727 | 9/1948 | Oetzel | 335/256 |
| 2,859,391 | 11/1958 | Ericson | 260/942 |
| 2,878,445 | 3/1959 | Scarborough | 324/208 |
| 2,925,538 | 2/1960 | Rasmusen | 335/245 |
| 3,185,909 | 5/1965 | Jahn | 318/135 |
| 3,219,853 | 11/1965 | Schreiber | 310/14 |
| 3,219,888 | 11/1965 | Waring | 335/290 |
| 3,340,442 | 9/1967 | Braillon | 335/290 |
| 3,394,325 | 7/1968 | Zimmer | 335/81 |
| 4,097,833 | 6/1978 | Myers | 335/261 |
| 4,185,261 | 1/1980 | Nagata | 335/291 |

*Primary Examiner*—Harold Broome

*Attorney, Agent, or Firm*—Peter Abolins; Clifford L. Sadle

[57] ABSTRACT

This specification discloses a solenoid actuator which combines a fast response with a high force capability. A multitude of magnetic poles act in parallel to create a traction force which is a function of the number of magnetic poles and with fast dynamic response which is independent of the magnitude of the force and the size of the solenoid.

15 Claims, 14 Drawing Figures

RING-SHAPED MULTIPOLE SOLENOID

FIG 1 RING-SHAPED MULTIPOLE SOLENOID

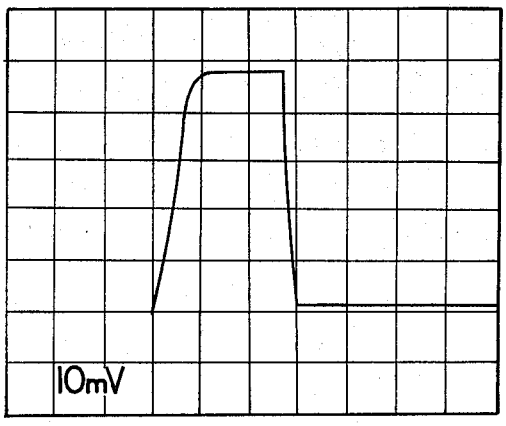
FIG. 6 CURRENT TRACE OF A MULTIPOLE SOLENOID
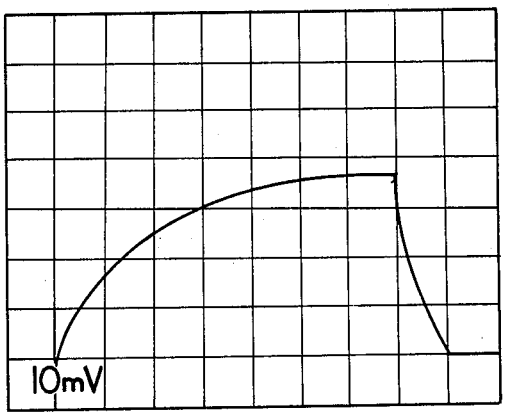
FIG 7 CURRENT TRACE OF A CONVENTIONAL SOLENOID

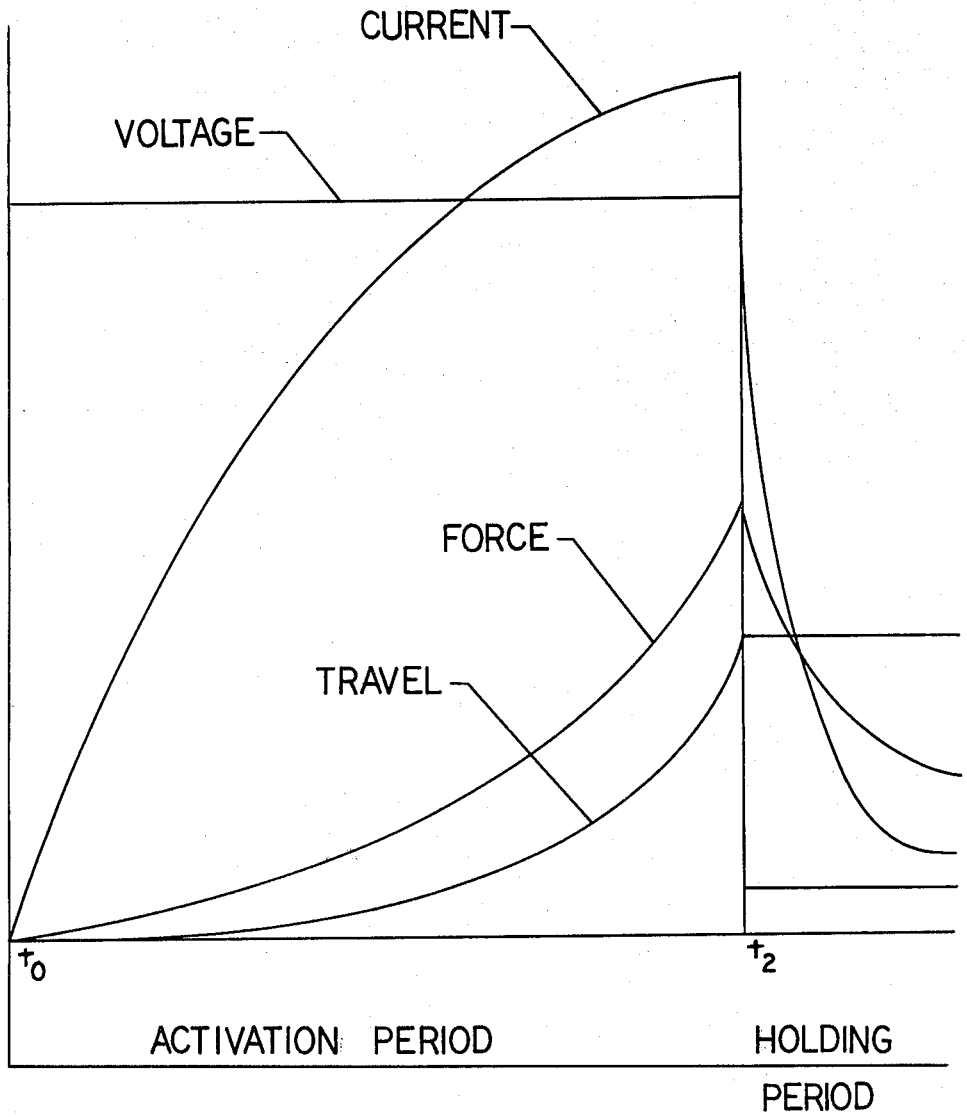
FIG 8 CONVENTIONAL SOLENOID ACTIVATIONAL

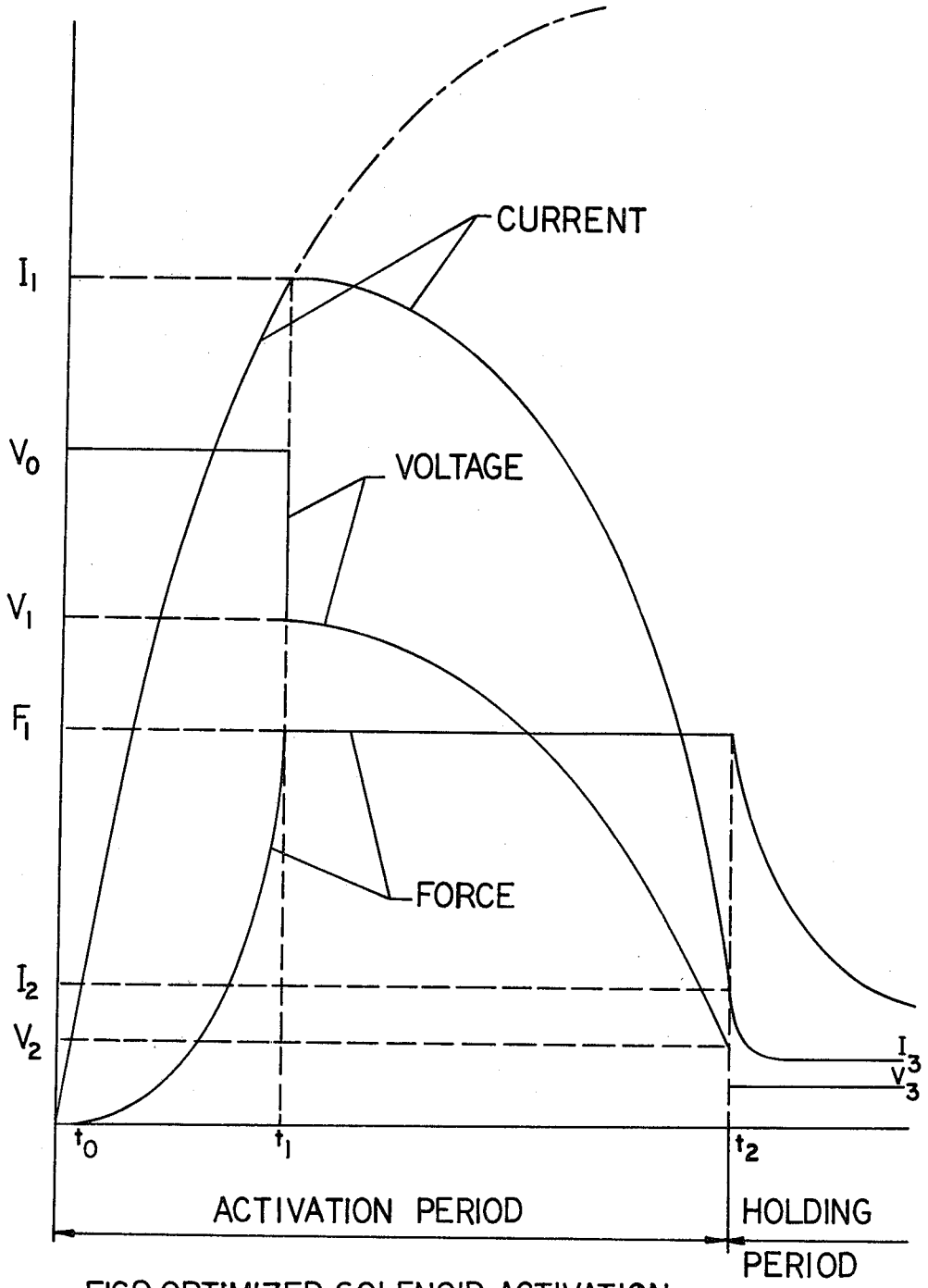
FIG.9 OPTIMIZED SOLENOID ACTIVATION CURRENT VOLTAGE AND FORCE

OPTIMIZED SOLINOID ACTIVATION
ACCELERATION, VELOCITY AND TRAVEL

MULTIPOLE SOLENOIDS

BACKGROUND OF THE INVENTION

1. Field of the Invention

This invention relates to an electromagnetic device which converts electrical energy into mechanical energy.

2. Prior Art

The ever growing use of electronic controls in automobiles has led to an increase in application of electric actuators. At present, solenoids are the most widely used electric actuators in automotive controls. In the past, solenoids have been used mostly to perform occasional switching functions in which the response time of the solenoid was not very important. However, the recent advances in automotive electronics have led to increased usage of solenoid actuators in performance of functions of substantial complexity, such as control and operation of a fuel injection system, in which the response of the solenoid to the control signal and the speed of its operation are critical to the overall performance of the system.

The response of a solenoid to a voltage signal is determined by two factors: the time constant of the solenoid coil and the ratio of the magnetic traction force to the moving mass. The time constant determines the time delay involved in building up the magnetic force to the required magnitude, while the force to mass ratio represents the acceleration of the moving mass. It is easier to achieve fast response in small solenoids producing small forces than in large units capable of generating substantial traction forces. Nevertheless, it is the ability of a solenoid to combine a large force capability with a very fast response that often is the most sought after property of a solenoid actuator.

Analysis of mathematical relationships between various parameters of a solenoid coil indicates that the time constant T can be approximately expressed as a function of three parameters: the traction force of a single magnetic pole F, the initial air gap length l, and the power input P. The time constant of a solenoid coil is directly proportional to the product of the traction force and the air gap length and inversely proportional to the electrical power input, $$T=(2\ F\ l/P$$

The force F and the air gap length l in the above equation are usually fixed design parameters of the solenoid. Therefore, for given values of the traction force and the air gap length, the time constant is a function of the input power only, to which it is inversely proportional. A fast response solenoid is a high energy solenoid and must have a high power to force ratio, at least during the activation period.

For a given air gap length, increase in the traction force leads to an increase in the time constant, unless the electric power input is increased in the same proportion as the force. Unfortunately, an increase in the electric power input is limited by the ability of the system to reject waste heat generated in the solenoid. Attempts to overcome this difficulty include using forced liquid cooling applied to a coil which is run at high temperature. An increase in the temperature of the coil is, of course, restricted by the ability of its materials to withstand heat. As a result, there is a limit to the amount of energy which can be safely put into a given induction coil.

In small induction coils with large surface to cross-sectional area ratios, reasonably high power to force ratios can be achieved. It is much more difficult, however, to achieve such favorable power to force ratios in large coils designed for large traction forces. One of the main reasons for this is that, if we attempt to prevent an increase in the time constant by increasing the power input at the same rate as the traction force, there is no corresponding increase in the volume and outer surface of the copper wire in which the heat is generated. Because of that the heat transfer conditions grow progressively worse and the coil overheats. As a result, large induction coils usually are restricted to smaller power to force ratios and have larger time constants than those which can be achieved in small coils.

The force to the moving mass ratio, usually, declines with increase in the force and size of the coil. This is due to the fact that the increase in force is proportional to the increase in the face area of the armature, while the moving mass is proportional to the volume of the armature which, due to a corresponding increase in its length, grows faster than the face area. This leads to smaller accelerations and, consequently, longer travel times in larger coils. Therefore, the response of a conventional solenoid becomes slower with increase in the force and size of the solenoid coil, due to concurrent increase in time constant and decrease in acceleration.

The prior art also teaches helical solenoid actuators as described in "Helenoid Actuators - A New Concept in Extremely Fast Acting Solenoids" by A. H. Seilly, Society of Automotive Engineers Technical Paper 790119, 1979. This construction uses a single magnetic core which is elongated and wound into a helical shape. The shape is generally of an E-shaped solenoid extended in a direction perpendicular to the three prong extensions of the E-shape. Such a shape is relatively difficult to fabricate and causes a certain amount of flux leakage which is then unavailable for creating armature movement. These are some of the problems this invention overcomes.

SUMMARY OF THE INVENTION

This invention avoids the problems associated with a large, high force solenoid having a relatively slow response characteristic due to long time constants and low force to moving mass ratio. This invention includes a solenoid configuration in which the time constant and the force to moving mass ratio are independent of the magnitude of the solenoid force, and in which a very short time constant and a large force to moving mass ratio can be achieved regardless of how large the magnetic traction force must be.

In accordance with an embodiment of this invention, an electromagnetic device includes a stator means and an armature means, the stator means having a plurality of pole means. The armature means is positioned adjacent the stator means for activation by the stator means. Induction coil means associated with alternating pole means for carrying an electric current establishing a magnetic flux in a first direction in the associated pole means and a magnetic flux in a second direction in the pole means adjacent the associated pole means. As a result, adjacent poles have opposite magnetic polarity.

BRIEF DESCRIPTION OF THE DRAWINGS

FIG. 6 is a graphical representation of the current versus time in a coil of a solenoid in accordance with an embodiment of this invention;

FIG. 7 is a graphical representation of the current versus time in a coil of a prior art solenoid;

FIG. 8 is a graphical representation of solenoid activation in accordance with the prior art including the variation with respect to time of the current, voltage, force and armature travel;

FIG. 9 is a graphical representation of solenoid activation in accordance with an embodiment of this invention showing an optimized schedule of current, voltage and force with respect to time;

DETAILED DESCRIPTION OF THE INVENTION

Figure 1:
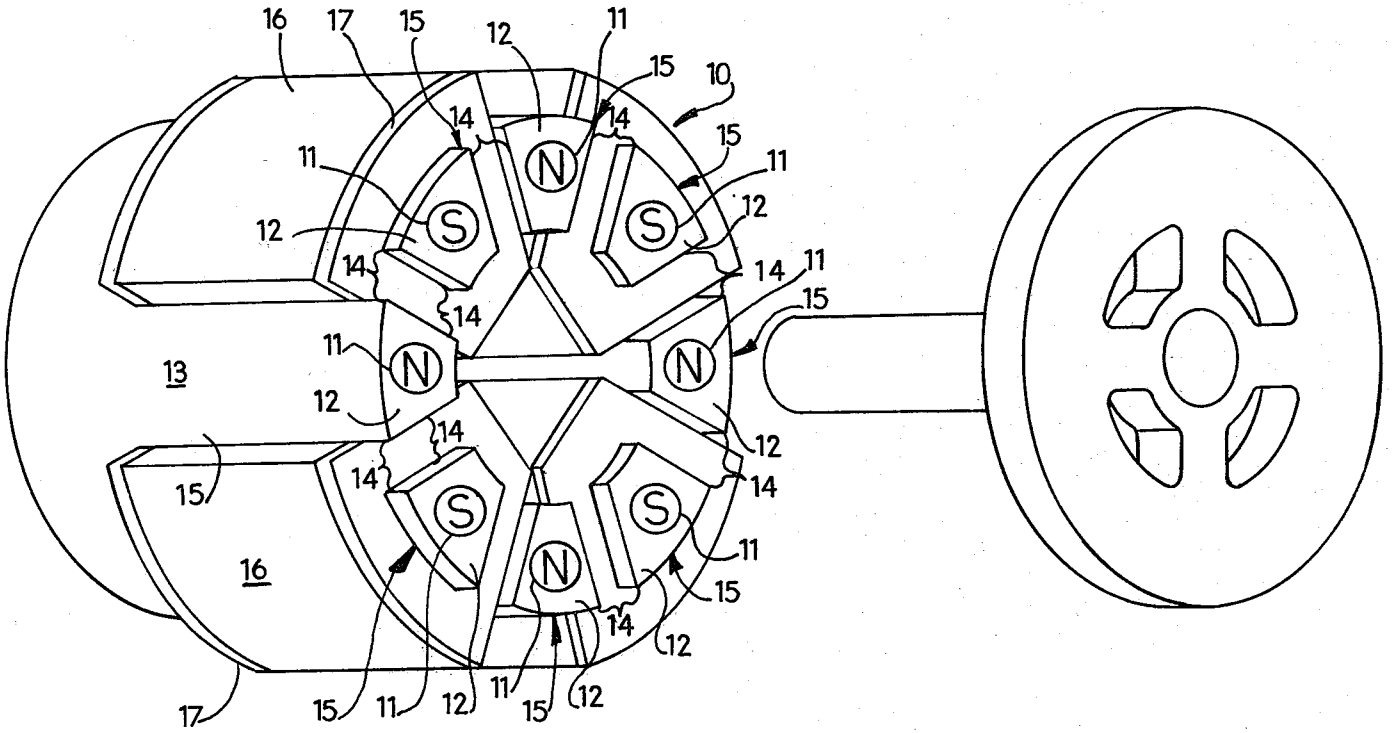
FIG. 1 is a perspective view of a ring shaped multipole solenoid stator and associated ring armature in accordance with an embodiment of this invention.

Referring to FIG. 1, a fast response ring-shaped multipole solenoid 10 has a plurality of magnetic poles 11 of alternating polarity positioned on a traction surface 12 of a solenoid core 13. Solenoid core 13 is tubular in shape with radial slots 14 forming eight long teeth 15 of approximately trapezodial cross section. Four solenoid coils 16 wound on suitably shaped plastic bobbins 17 are inserted on four trapezoidal teeth 15 as shown in FIG. 1. When electric current is run through the windings of the coils 16, eight magnetic poles 11 appear on the faces of the eight teeth 15, each exerting a magnetic traction force on a ring-shaped armature 18 which moves in an axial direction toward solenoid core 13.

Figure 2:
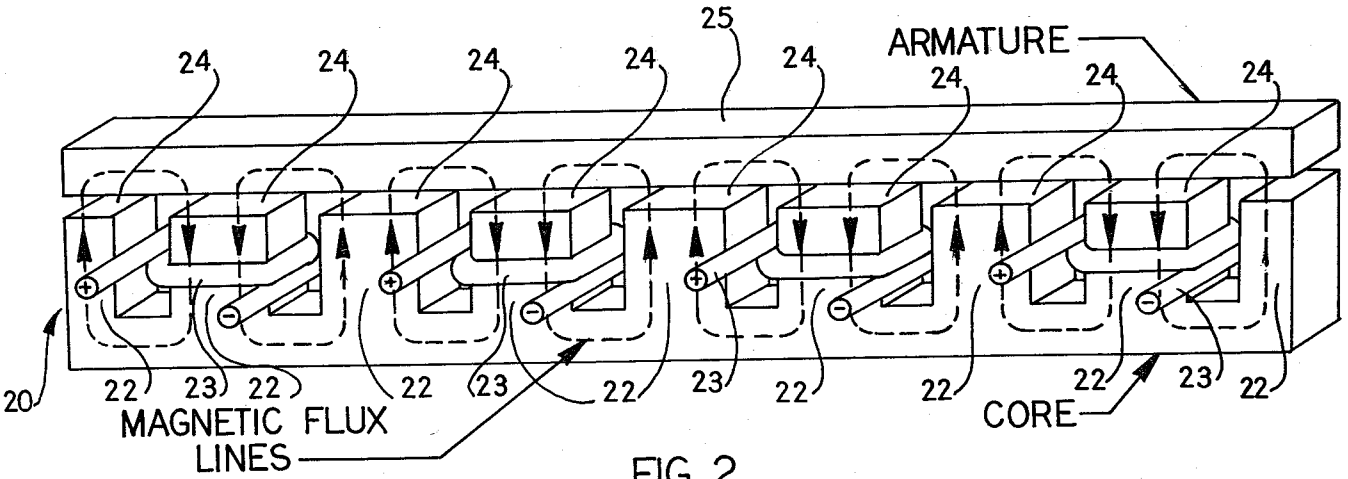
FIG. 2 is a linear multipole solenoid with coils an alternating poles in accordance with an embodiment of this invention.
Figure 3:
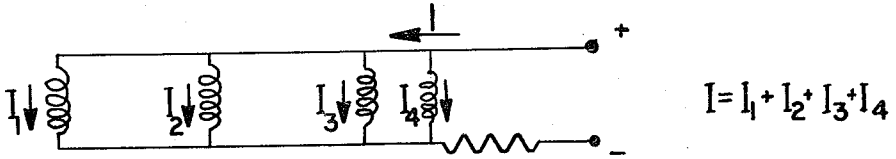
FIG. 3 is a circuit diagram of the connection of the coils in the solenoid of FIG. 2.

For ease of explanation consider a linear multipole 20, which is functionally equivalent to the above described ring-shaped multipole 10. Such a device is shown in FIG. 2. The core 21 of the solenoid is a long rack with a multitude of rectangular teeth 22. A solenoid coil 23 is installed on every other tooth. The coils 23 can be connected so that they form a parallel electric circuit and the total solenoid current is equal to the sum of the currents in all individual coils (FIG. 3). They can also be connected in series so that the total solenoid current runs through all the coils. The magnetic fluxes of individual coils 23 form a parallel magnetic circuit, as shown in FIG. 2.

The top faces 24 of the rectangular teeth 22 form the traction surface of the solenoid on which a multitude of magnetic poles is formed. All the S-poles are formed on the top faces of teeth 22 with coils 23, while all the N-poles are on top faces 24 of teeth 22 without coils 23, or vice versa, depending on the direction of the current flow. A movable armature 25 is shaped as a long bar of the same length as core 21. The traction face acting on armature 25 is equal to the sum of the traction forces generated by all the individual magnetic poles. Since an individual coil 23 can be very small, it can be designed for a very small time constant, and the required total traction force, no matter how large, can be achieved by increasing the number of teeth and making the core rack and the armature bar as long as required. The time constant of such a linear multipole solenoid is the same as that of an individual single coil and thus can be very small regardless of the magnitude of the total traction force. The total force is proportional to the length of the rack , and the mass of the movable armature is proportional to this length. Therefore, the force to the moving mass ratio is independent of the magnitude of the force and the size of the solenoid. This ratio, even for a very long linear multipole, remains the same as for a short single coil solenoid.

The same reasoning as above can be applied to the ring-shaped multipole. Whenever a larger force solenoid is needed, this can be accomplished by enlarging the diameter of the tubular core and increasing the number of coils while keeping the size, the force, and the time constant of each coil the same as before. The time constant of the entire solenoid will always be equal to that of an individual coil and, thus, will remain the same regardless of the total number of coils. The number of magnetic poles on the traction surface of the core is always twice the number of coils. The mass of the armature ring will increase in the same proportion as the number of coils and, thus, the mass to force ratio will remain unchanged. Therefore, the response of such a solenoid can be substantially independent of its size and force; and multipoles, capable of very large forces, can be designed for fast response usually associated with small solenoid coils.

Figure 4:
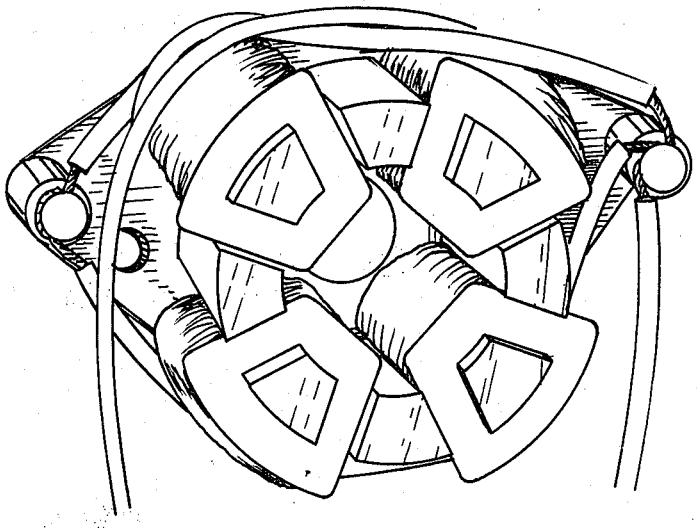
FIGS. 4 and 5 are views of four and eight coil solenoids, respectively in accordance with an embodiment of this invention.
Figure 5:
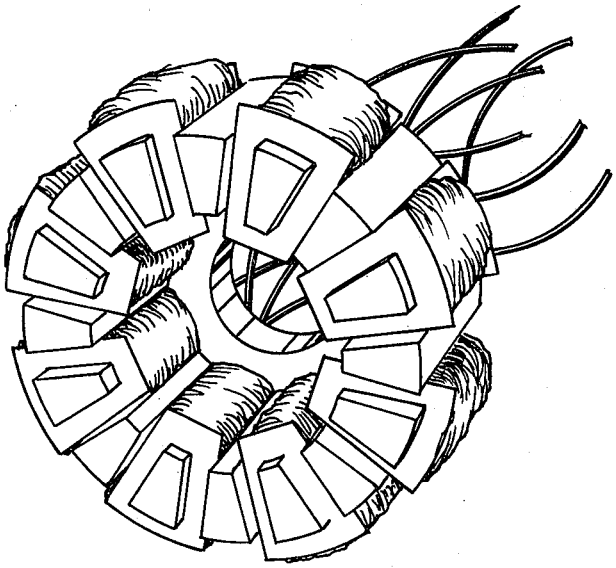

The different multipole solenoids for various applications are shown in FIGS. 4 and 5. FIG. 4 shows a 4-coil solenoid core 40. FIG. 5 illustrates a much larger 8-coil multipole 50. FIG. 6 shows an oscilloscope current trace for the 4-coil solenoid at a constant 0.9 mm air gap. For comparison, FIG. 7 shows a current trace produced by a conventional plunger-type solenoid which, at the same 0.9 mm air gap and the same voltage, generates equal traction force. The rate of the current rise in the multipole solenoid is much faster than in the conventional one.

The core and the armature of each multipole solenoid can be made of low carbon steel and subjected to magnetic annealing after fabrication. Prefabricated individual coils can be installed on the core by means of a light press fit. Ryton R-4 is a typical material used for coil bobbins. Due to the high temperature resistance offered by Ryton, the solenoid can be safely run at temperatures of up to 180° C. The high surface temperature coupled with intensive cooling by liquid fuel, flowing through and around the solenoid, provides for a very efficient waste heat rejection and, thus, permits high energy input during the activation period. Simple configuration of basic components and easy assembly make the multipole solenoids quite suitable for mass production.

Since the key to a fast response in a solenoid is its ability to absorb input energy at high rate during the activation period, it is advantageous to obtain an optimum schedule of energy flow into the solenoid coil, which will assure the required speed of response with minimum energy input. The usual schedule of solenoid activation involves application of a voltage pulse of a constant magnitude for the duration of the activation period. During this time the current approaches its maximum value, and the air gap is reduced to its minimum value. The flux density and the traction force increase and reach their maximum values at the end of the armature travel. Then, the current is reduced to a minimum value necessary to keep the armature in place during the holding period. At the beginning of the armature travel, the traction force is small. Because of that, the movement of the armature is initially slow, and most of the travel takes place at the very end of the activation period. This is shown in FIG. 8.

The travel time can be reduced if the maximum traction force, which is determined by the saturation flux density and the face area of the solenoid, is achieved early in the armature travel, so that the armature is driven with maximum acceleration during most of the travel time. This requires not only very fast current rise, but also very high value of peak current, since the saturation flux density must be achieved while the air gap is still large. However, as the armature travel reduces the air gap and the reluctance of the magnetic circuit decreases, the current can be gradually reduced, while the traction force remains constant.

FIG. 9 shows a graph of such an optimized current pulse, as well as the voltage and traction force graphs during the solenoid activation period. The resistance of the coil is very low, relative to the applied voltage, but the current is not allowed to rise to its steady state value, determined by the Ohm's law. Only the initial portion of the current rise curve, where the current rise rate is the fastest, is utilized. The unused portion of the current rise curve, for $t>t_1$, is shown as a phantom line in the graph. From time $t_o$ to $t_1$, the voltage remains constant, and both the current and the traction force rise rapidly. At time $t_1$, the flux density approaches the saturation level, and the traction force achieves its maximum value $F_1$. The value of current is $I_1$. At this point, further increase in the magnitude of the current becomes useless, and a step change in the applied voltage from the initial value $V_o$ to $V_1$ terminates the rise of the current. From time $t_1$ to $t_2$ the voltage is gradually reduced from $V_1$ to $V_2$. The current decreases from $I_1$ at $t_1$ to $I_2$ at $t_2$. The decline in current is tailored so that it is compensated for by a concurrent reduction in the air gap, and the traction force remains at its maximum level $F_1$. At time $t_2$ the voltage drops to $V_3$ and the current decreases to a low level $I_3$ sufficient to hold the armature in place during the holding period. The power consumption reaches its maximum at time $t_1$, when both the current and the voltage are at their peak values, and then rapidly declines during the remaining portion of the activation period.

Figure 10:
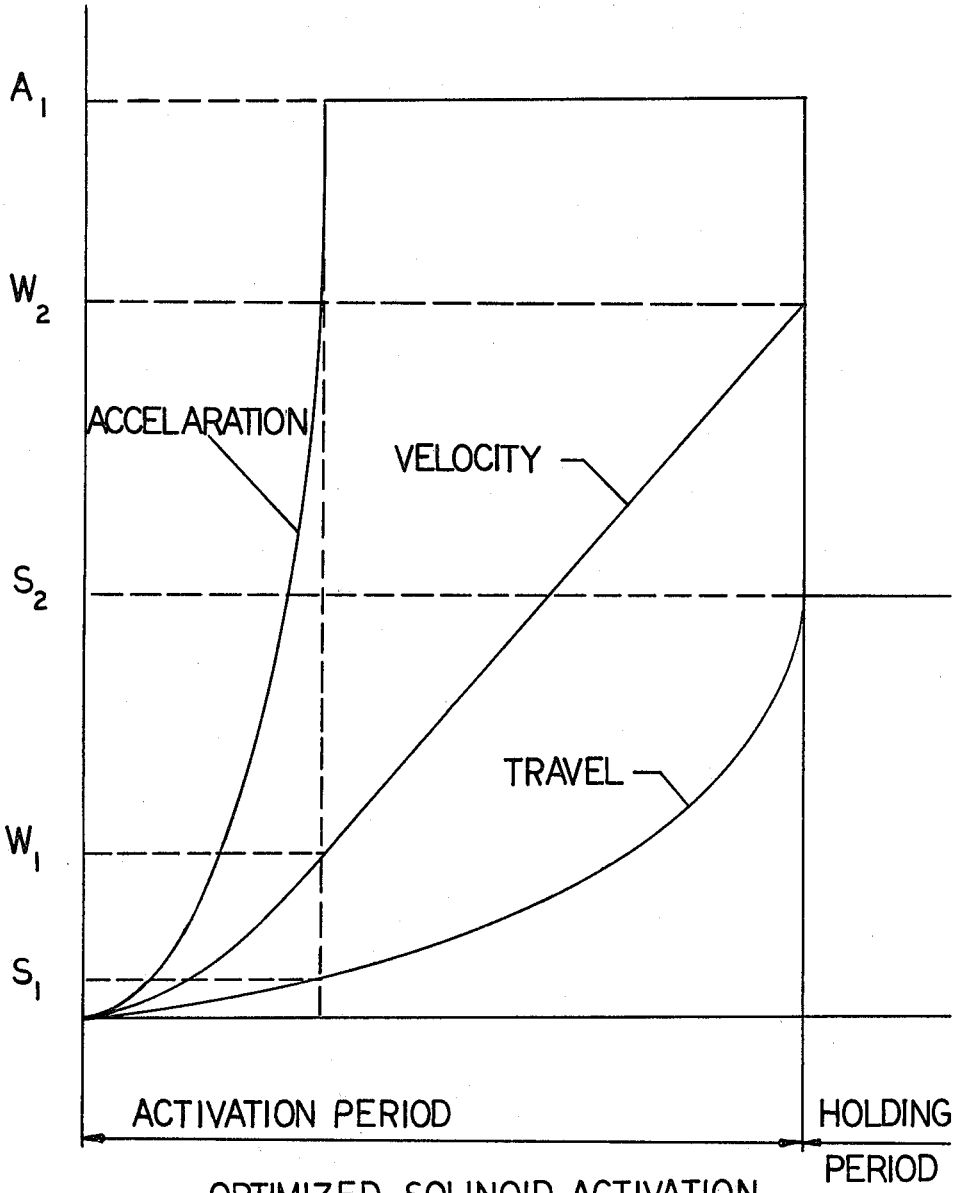
FIG. 10 is a graphical representation of activation of a solenoid in accordance with an embodiment of this invention showing an optimized schedule of acceleration, velocity and travel with respect to time.

FIG. 10 shows graphs of the armature acceleration, velocity and travel as functions of the travel time. The dynamics of the armature travel is fully determined by the traction force, the restoring force, and the armature mass. The restoring force is, usually, very small, in comparison to the traction force, and often can be neglected.

Although the trapezoidal shape of coil cross section is the most natural one for the ring shaped multipole solenoid, various other coil shapes and many other multipole solenoid arrangements can be used.

Figure 11:
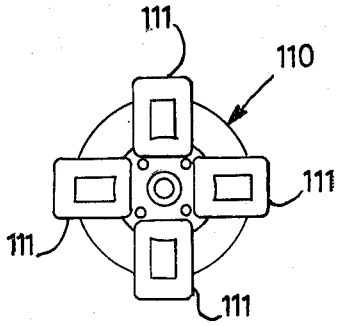
FIG. 11 is a ring shaped multipole solenoid with four rectangular coils.
Figure 12:
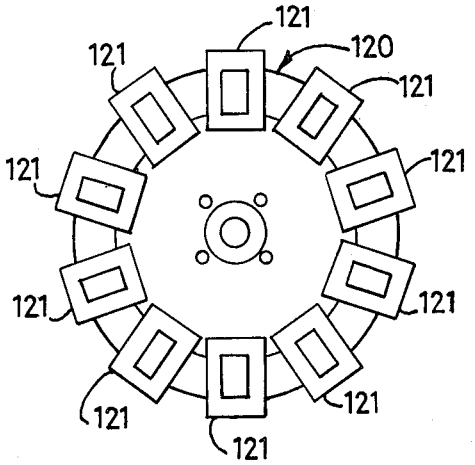
FIG. 12 is a ring shaped multipole solenoid with ten rectangular coils.

FIG. 11 shows a ring shaped multipole solenoid 110 with rectangular coils 111. The cores for the individual coils are formed by cutting two parallel and equidistant from the diameter slots in the ring shaped stator in one direction and two more such slots in perpendicular direction. When a solenoid with a larger traction force is required, this can be accomplished simply by incorporating a larger number of identical coils. FIG. 12 shows a solenoid 120 very similar to the one shown in FIG. 11 but with ten rectangular coils 121. The traction force of the ten coil solenoid is two and a half times larger than that of the four coil solenoid, and yet the time constants of the two solenoids are equal. The increase in force was achieved without any increase in the length of time constant which always remains the same as that of an individual coil. To reduce the mass of the movable armature in the larger solenoid, the armature ring is connected to its hub by means of light spokes. The rectangular cross section for the coils is advantageous because the same coil can be used to form multipole solenoid rings of different diameter. In contrast, different size trapezoidal coil cross sections are associated with solenoid rings of different diameter.

Figure 13:
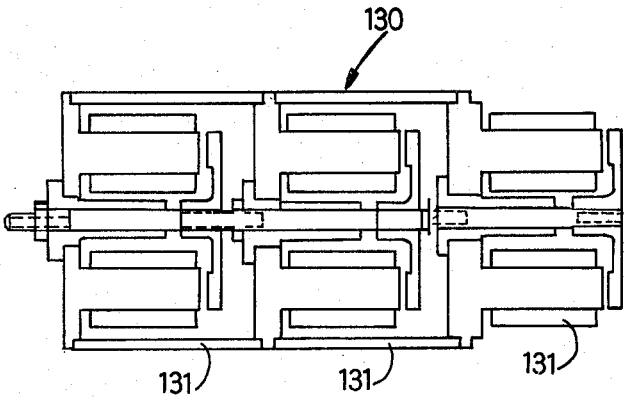
FIG. 13 is a side view of a plurality of solenoids joined coaxially to increase force in accordance with an embodiment of this invention.

FIG. 13 illustrates another multipole solenoid 130 arrangement in which several small solenoids 131, like the one in FIG. 11 are arranged in a series, so that their forces are additive. Such an arrangement is useful whenever there is no room to increase the diameter of the solenoid.

Figure 14:
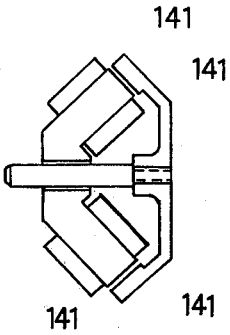
FIG. 14 is a side view of a solenoid with angled poles in accordance with an embodiment of this invention.

FIG. 14 shows another modification of the multipole solenoid similar to that shown in FIG. 11 but with conical traction surfaces 141 on the stator and the armature instead of two parallel planes, as in FIG. 1.

Various modifications and variations will no doubt occur to those skilled in the various arts to which this invention pertains. For example, the size and particular cross sectional shape of the stator teeth may be varied from that disclosed herein. These and all other variations which basically rely on the teachings through which this disclosure has advanced the art are properly considered within the scope of this invention.

I claim:

1. An electromagnetic device comprising:

a stator means having a plurality of pole means;

an armature means positioned adjacent said stator means for activation by said stator means and being movable with respect to said stator means;

an air gap positioned between said stator means and said armature for passing a magnetic flux, said air gap having a size dependent upon the relative positions of said stator means and said armature; and induction coil means associated with alternating pole means for carrying an electric current and establishing a magnetic flux in a first direction in said associated pole means and a magnetic flux in a second direction in said pole means adjacent said associated pole means, thus forming magnetic poles of opposite polarity at the extremities of adjacent pole means, said induction coil means being adapted to carry an electric current so that at each instant during travel of said armature means the magnitude of the electric current is substantially that required to maintain the magnetic flux density in said air gap at saturation level, the electric current in said induction coil means rising relatively fast upon initial relative movement to a relatively high magnitude so that saturation magnetic flux density is achieved after a relatively small amount of travel of said armature means, the electric current decreasing from said relatively high magnitude as a function of the reduction in said air gap; and all of said induction coil means being substantially identical with one another, having substantially identical electrical time constants and producing substantially identical magnetic traction forces, the total traction force of said electromagnetic device being substantially equal to the sum of forces of all of said induction coil means and the electric time constant of said electromagnetic device being substantially equal to the time constant of a single induction coil means associated with a single pole means.

2. An electromagnetic device as recited in claim 1 wherein said stator means is generally cylindrically shaped with a hollow center and having radial slots thereby forming teeth extending axially from a ring.

3. In an electromagnetic device as recited in claim 1 wherein said stator means is generally elongated with transversely extending teeth positioned at spaced locations along the length of said stator means.

4. An electromagnetic device as recited in claim 2 wherein said armature means is shaped as a ring similar in size to the stator means.

5. An electromagnetic device as in claim 3 wherein said armature means is an elongated bar aligned with and having the same length as said stator means.

6. An electromagnetic device as recited in claim 1 wherein said stator has conical traction surfaces and said armature means has a conical traction surface.

7. An electromagnetic device comprising:

stator means comprising a plurality of closed flux carrying paths including a core and an air gap in said core defined by a first and second pair of pole faces, adjacent ones of said flux path sharing a common core for at least a portion of the flux path;

coil means comprising means for generating electromagnetic flux in said closed flux carrying paths, the direction of flux flow across said air gaps exiting from one pole in a first direction and entering a second pole in a second direction, said second direction being substantially opposite from said first direction;

armature means mounted on said device to be movable in a direction perpendicular to the plane of the pole faces and extending along a direction parallel to the pole faces;

said air gap passing a magnetic flux and having a variable size dependent upon the relative positions of said stator means and said armature means;

said coil means being adapted to carry an electric current so that at each instant during travel of said armature means the magnitude of the electric current is substantially that required to maintain the magnetic flux density in said air gap at saturation level, the electric current in said coil means rising relatively fast upon initial relative movement between said stator and armature means to a relatively high magnitude so that saturation magnetic flux density is achieved after a relatively small amount of travel of said armature means, the electric current decreaasing from said relatively high magnitude as a function of the reduction in said air gap; and all of said coil means being substantially identical with one another, having substantially identical electrical time constants and producing substantially identical magnetic traction forces, the total traction force of said electromagnetic device being substantially equal to the sum of forces of all of said coil means and the electrical time constant of said electromagnetic device being substantially equal to the time constant of a single coil means associated with a single pole means.

8. An electromagnetic device as recited in claim 7 wherein said stator means has a plurality of teeth for forming the poles extending from a common member, said common member forming a portion of the plurality of flux paths.

9. An electromagnetic device as recited in claim 8 wherein said coil means comprises turns of current conducting material wound around alternating magnetic poles, each pole containing two adjacent flux paths.

10. An electromagnetic device as recited in claim 9 wherein said coil means includes additional current carrying conductors wound around the teeth between said alternating magnetic poles so that each pole has coils wound around it.

11. An electromagnetic device as recited in claim 8 wherein said stator means is ring shaped and has individual poles with a generally trapezoidal cross section.

12. An electromagnetic device as recited in claim 11 wherein said generally trapezoidal cross sections have the opposing unequal length sides curved so that the stator forms part of a cylinder.

13. An electromagnetic device as recited in claim 12 wherein said coil means is wound around on an insulating material which can be removably fitted on a pole.

14. An electromagnetic device as recited in claim 13 wherein the current carrying coils are connected in parallel.

15. An electromagnetic device as recited in claim 13 wherein the current carrying coils are connected in series.

* * * * *